United States Patent [19]

Hatanaka et al.

[11] Patent Number: 4,772,334

[45] Date of Patent: Sep. 20, 1988

[54] PROCESS FOR PRODUCING HIGHLY PURE RHAMNOSE FROM GUM ARABIC

[75] Inventors: Masayoshi Hatanaka; Eizi Yokoyama; Masatoshi Sano; Satoru Kumazawa; Tsutomu Takagi, all of Iwaki, Japan

[73] Assignee: Kureha Kagaku Kogyo Kabushiki Kaisha, Tokyo, Japan

[21] Appl. No.: 887,867

[22] Filed: Jul. 18, 1986

Related U.S. Application Data

[63] Continuation-in-part of Ser. No. 810,646, Dec. 18, 1985, abandoned.

[30] Foreign Application Priority Data

Dec. 20, 1984 [JP] Japan ..... 59-268873

[51] Int. Cl.[4] ..... C13K 13/00; C13K 1/04

[52] U.S. Cl. ..... 127/36; 127/37; 127/1; 127/46.1; 127/46.2; 127/48; 127/49; 127/50; 127/55; 536/124; 536/128

[58] Field of Search ..... 127/37–46.1, 127/46.2, 46.3, 36, 48–50, 55–57; 536/127, 128, 124

[56] References Cited

U.S. PATENT DOCUMENTS 4,587,953 5/1986 Rosene ..... 127/46.2

OTHER PUBLICATIONS

*Chemical Abstract,* vol. 98, 1983, p. 369, Abstract No. 158949z, Nagata et al., "Exohemagglutinin Produced by Streptococcus".

*Chemical Abstract,* vol 99, 1983, p. 469, Abstract No. 138300y, Bokhary, H. A., "Gamma Irradiation Effects on Carbohydrates Composition, Growth of Microorganisms and ESR Spectra of Gum Arabic".

*Acta Chemica Scandinavica,* vol. 9, No. 6, (1965), pp. 1357–1364.

*Primary Examiner*—Asok Pal
*Assistant Examiner*—Chung K. Pak
*Attorney, Agent, or Firm*—John P. White

[57] ABSTRACT

Disclosed herein is a process for producing highly pure rhamnose from gum arabic, which the process comprises after partially hydrolyzing gum arabic in an aqueous solution of a mineral acid, neutralyzing and condensing the liquid hydrolyzate, thereby obtaining an aqueous solution containing from 40 to 70% by weight of organic substances, adding a polar organic solvent in an amount of from 5 to 20 times by volume of the amount of the aqueous solution, thereby precipitating an insolubilized substance, removing the insolubilized substance from a mixture of the aqueous solution and the polar organic solvent, removing the polar organic solvent from the mixture, thereby obtaining an aqueous solution containing monosaccharides formed by the hydrolysis of gum arabic, and subjecting the thus obtained aqueous solution to strongly cationic ion-exchanging resin-chromatography and then to a method of adsorption and separation by using activated carbon, thereby obtaining the highly pure rhamnose from the aqueous solution.

7 Claims, 2 Drawing Sheets

PROCESS FOR PRODUCING HIGHLY PURE RHAMNOSE FROM GUM ARABIC

CROSS-REFERENCE TO RELATED APPLICATION

The present application is a continuation-in-part of application Serial No. 810,646, filed Dec. 18, 1985, now abandoned.

BACKGROUND OF THE INVENTION

The present invention relates to a process for producing highly pure rhamnose from gum arabic.

Rhamnose is present in nature as a saccharide component of glycosides such as rutin (containing 26.8% by weight of rhamnose), hesperidin (containing 29.5% by weight of rhamnose), quercitrin (containing 40% by weight of rhamnose), myricitrin and naringin, and as a saccharide constructing gum arabic.

Hitherto, the production of rhamnose has been effected by hydrolyzing one of the above-mentioned glycosides of a high content of rhamnose, however, it is difficult from the view point of amount and cost to supply rhamnose as the industrial starting material because of the small production of the above-mentioned glycosides and the high price thereof.

In addition, in the case of using rutin as the starting material, contamination by quercetin which is suspected of carcinogenesis is considered and accordingly rhamnose from rutin is not desirable in its use.

Although as an another method of producing rhamnose, a process comprising culturing a species of bacteria belonging to the genus Pseudomonas, thereby obtaining a rhamnolipid produced by the bacteria and producing rhamnose from the rhamnolipid has also been known, the productivity of rhamnose by the process is not necessarily satisfactory.

In consideration of the above-mentioned situation, the object of the present invention is to provide a process for producing rhamnose of a high purity at a high efficiency from gum arabic which is available in a relatively large amount in nature as a rhamnose-containing substance.

Gum arabic is a substance secreted from the trunks of a leguminous plant belonging to the genus Acacia, and is utilized commercially in a broad field. Particularly, since gum arabic has been used as a stabilizer and an emulsifier of foods and medicines for a long time and there has been no problem in its safety in human life, there is a merit that rhamnose produced from gum arabic can be used without any restriction. The major component of gum arabic comprises lysaccharides of presumed structural formulae, generally composed mainly of galactose while being accompanied by arabinose, rhamnose, glucuronic acid, etc. and it is considered that rhamnose is present as the saccharide at the molecular end of gum arabic.

As a result of the present inventors' studies for the process of hydrolyzing gum arabic and the method for treatment of the liquid hydrolyzate of gum arabic, it has been made possible by the present inventors to increase the amount of rhamnose in the total amount of the monosaccharides obtained by hydrolysis of gum arabic, to improve the efficiency for separating rhamnose from the hydrolyzate and to obtain rhamnose of a high purity, and based on the present inventors' findings the present invention has been attained.

BRIEF EXPLANATION OF DRAWINGS

Of the attached drawings.

SUMMARY OF THE INVENTION

Figure 1:
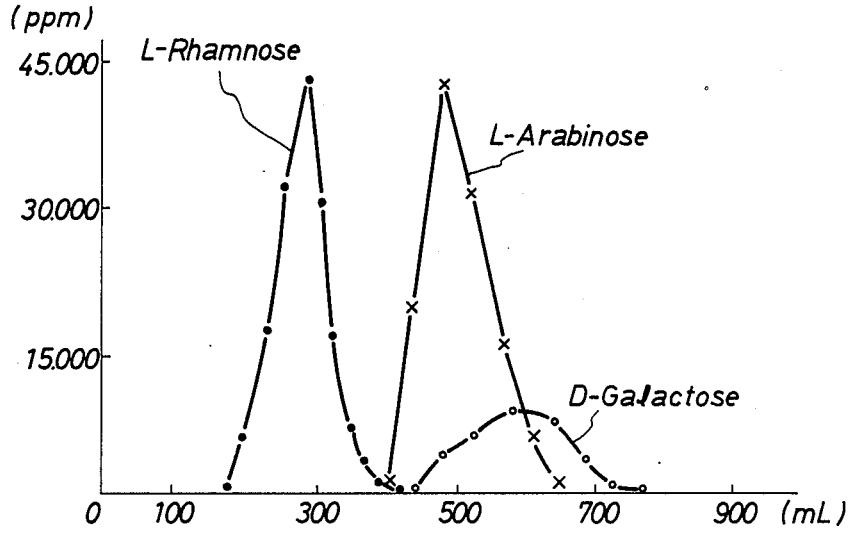
FIGS. 1, 2 and 3 show the eluting curves of L-rhamnose (shown by—•—•— •—•—), L-arabinose (shown by -x-x-) and D-galactose (shown by—∘—∘—∘—∘) in Examples 2, 3 and 4, respectively.

In an aspect of the present invention, there is provided a process for producing highly pure rhamnose from gum arabic, which the process comprises hydrolyzing partially gum arabic in an aqueous solution of a mineral acid, neutralyzing and condensing the thus obtained liquid hydrolyzate, thereby obtaining an aqueous solution containing from 40 to 70% by weight of an organic substance, adding to the thus obtained aqueous solution of a polar organic solvent in an amount of from 5 to 20 times by volume of the amount of the aqueous solution, removing the thus precipitated, insolubilized substance from the mixture, removing the polar organic solvent from the mixture, thereby obtaining an aqueous solution containing monosaccharides formed by the partial hydrolysis of gum arabic, and subjecting the thus obtained aqueous solution containing monosaccharides to strongly cationic ion-exchanging resin-chromatography and to a method of adsorption and separation by using activated carbon to obtain highly pure rhamnose.

DETAILED DESCRIPTION OF THE INVENTION

The characteristic feature of the present invention is the production of rhamnose from gum arabic and the purification of the thus produced rhamnose by the steps of (1) after partially hydrolyzing gum arabic in an aqueous solution of a mineral acid, neutralizing and condensing the thus obtained liquid hydrolyzate, thereby obtaining an aqueous solution containing from 40 to 70% by weight of monosaccharides, (2) adding to the condensed aqueous solution a polar organic solvent in amount of from 5 to 20 times by weight of the amount of the aqueous, solution, thereby precipitating an insolubilized substance, (3) removing the thus precipitated, insolubilized substance from a mixture of the aqueous solution and the polar organic solvent, by filtration, centrifugation or sedimentation, (4) removing the polar organic solvent from the mixture by evaporation, such as distillation, thereby obtaining an aqueous solution mainly containing monosaccharides and (5) subjecting the thus obtained aqueous solution to strongly cation ion-exchanging resin-chromatography to remove mainly D-galactose and L-arabinose and to a method of adsorption and separation by using activated carbon to remove colored substances.

In the hydrolysis of gum arabic, it is preferable for the succeeding operations and the yield of the product to separate all of rhamnose bonded to the terminal part of the polysaccharide structure of gum arabic while suppressing the separation of other saccharides constituting gum arabic such as L-arabinose and D galactose, particularly galactose, as far as possible. For that purpose, an aqueous 0.1 to 0.6N, preferably 0.2 to 0.4N solution of the mineral acid is used as the aqueous solution of the mineral acid for dissolving gum arabic, and after dissolving from 5 to 30% by weight of gum arabic in this aqueous solution of the mineral acid, the solution is heated for from one to three hours to hydrolyze gum arabic therein.

In the case where the concentration of the mineral acid in the aqueous solution is too high in the hydrolysis, not only the thus formed rhamnose itself is hydrolyzed but also the hydrolysis of gum arabic proceeds more than necessary, thereby raising the ratio of galactose in the thus formed monosaccharides and resulting in the difficulty of the succeeding treatments.

On the other hand, in the case where the concentration of the mineral acid in the aqueous solution is extremely low, although the ratio of galactose in the liquid hydrolyzate is low, the hydrolytic velocity is low resulting in poor efficiency. Namely, it is preferable to effect the hydrolysis to the extent that $\frac{1}{3}$ to $\frac{1}{2}$ of the constructing saccharides of the gum arabic, such as L-rhamnose, L-arabinose and D-galactose converts into monosaccharides. By effecting the hydrolysis as shown above, the ratio of the monosaccharides obtained by the hydrolysis, i.e., rhamnose: arabinose: galactose is about 1:2:1, and more than 93% of rhamnose units which has partially constructed gum arabic is converted to monosaccharide.

After finishing the hydrolytic treatment of gum arabic, the liquid hydrolyzate is neutralized by adding aqueous solution of an alkali, adjusting a pH of the hydrolyzate at 6.5–7.5 and then the solvent of the liquid hydrolyzate is changed from water to a mixture of water and a polar organic solvent, thereby precipitating the substances of high molecular weights from the liquid hydrolyzate and the thus precipitated substance are removed. It has been found in the above-mentioned operations that in the case where the ratio of water to the polar organic solvent is in the range of 1:5 to 1:20 (by volume) in the mixture of water and the polar organic solvent, monosaccharides are partially insolubilized according to the concentration thereof and accordingly the ratio of monosaccharides remaining in the solution is changed drastically.

Namely, in the case where the liquid hydrolyzate is condensed to the extent that the concentration of monosaccharide formed by hydrolysis is from 40 to 70% by weight of the condensate, and a polar organic solvent in an amount of from 5 to 20 times by weight of the amount of the condensate is added to the condensate, the whole amount of the high-molecular weight substance and about the half amount of the monosaccharides precipitate as an insolubilized material, and the ratio of the monosaccharides in the remaining solution, i.e., rhamnose: arabinose: galactose, is about 1:1:0.3.

As the polar organic solvent, acetone, ethanol, isopropyl alcohol, acetonitrile, etc. may be exemplified, and the more preferable ratio of the polar organic solvent to water differ among different solvents. For example, in the case of acetone, the ratio of acetone to water is in the range of 5:1 to 20:1 (by volume), and in the case of acetonitrile, the ratio of acetonitrile to water is in the range of 10:1 to 20:1 (by volume).

As has been stated, in the mixture of the neutralized and condensed liquid hydrolyzate and the thus added polar organic solvent, the monosaccharides are present mainly in the dissolved state at the above-mentioned mutual ratio, and after removing the polar organic solvent from the mixture, the thus obtained aqueous solution containing the monosaccharides is subjected to strongly cationic ion-exchanging resin-chromatography and then to a method of adsorption and separation by using activated carbon, thereby rhamnose is available in a high purity of higher than 99%.

However, according to the above-mentioned treatment, about the half amount of rhamnose formed by hydrolysis precipitates as the insolubilized substance when adding the polar organic solvent to the neutralized and condensed liquid hydrolyzate.

Accordingly, in the present invention, for obtaining rhamnose in a high yield, the thus precipitated, insolubilized substance is further dissolved in water, and the polar organic solvent in an amount of 2 to 3 times by weight of the amount of water used in dissolving the insolubilized substance is added to the thus obtained aqueous solution, thereby precipitating a portion of the insolubilized substance. After removing the thus precipitated, insolubilized substance (referred to as the second precipitate) from the mixture, the remaining liquid layer (if necessary, is condensed and dissolved again with a small amount of water) is added to the neutralized and condensed hydrolyzate containing from 40 to 70% by weight of orgahic substances, and the thus formed mixture is added to the polar organic solvent.

By adopting the just-mentioned step, more than 93% of rhamnose originally constructed gum arabic can be collected as the product. For reference, the content of rhamnose in the second precipitate is less than 7% of the total content thereof in gum arabic.

The treatment of the aqueous solution containing rhamnose by the strongly cationic ion-exchanging resin-chromatography may be carried out by the ordinary method used in the separation analysis of a mixture of monosaccharides, however, separation of rhamnose from the mixture of rhamnose, arabinose and galactose has been hitherto scarcely carried out except only for a known analytical method of using an aqueous 92.4% solution of ethanol as the eluent at a temperature of 75° or 100° C.

As a result of the present inventors' study on such a treatment at lower temperatures, it has been further found that the separation can be carried out at 55° C. in the case of using an aqueous 65% solution of acetone and at ordinary temperature in the case of using an aqueous 75% solution of acetonitrile both as the eluent.

A mixture of from 40 to 20 parts by volume of water and from 60 to 80 parts by volume of acetone or acetonitrile is used as an eluent in the strongly cationic ion-exchanging resin-chromatography and the elution is carried out at a temperature from room temperature to 60° C.

Although the purity of rhamnose in the rhamnose fraction obtained by the treatment of the above-mentioned chromatography is in the range of from 96 to 98%, by treating the thus obtained rhamnose fraction with a method of adsorption and separation by activated carbon, it is possible to raise the purity of rhamnose to higher than 99.5%.

The present invention will be explained more in detail while referring to the non-limitative examples and comparative examples as follows.

EXAMPLE 1

To 250 g of powdery gum arabic, 1000 ml of 0.3N sulfuric acid were added, and after heating the mixture under a reflux condenser for 2.5 hours, the reaction mixture was neutralized by calcium hydroxide. The contents of rhamnose, arabinose and galactose as monosaccharides in the thus neutralized reaction mixture were 27.88 g, 55.89 g and 28.70 g, respectively. By condensing the neutralized reaction mixture while evaporating about 800 ml of water by heating , a condensate of about 200 ml was obtained. After adding 2000 ml of acetone to the condensate, stirring the mixture and leaving the mixture for 7 hours, the thus precipitated, insolubilized substance was removed from the mixture. The supernatant liquid contained 12.99 g of rhamnose, 12.05 g of arabinose and 2.99 g of galactose.

EXAMPLE 2

After neutralizing with potassium hydroxide, the liquid hydrolyzate obtained in the same manner as in Example 1 from 250 g of powdery gum arabic, the neutralized liquid hydrolyzate was condensed to about 200 ml. On the-other hand, the insolubilized substance separated in Example 1 was dissolved in 500 ml of water, the aqueous solution was heated to 50° C. and then 1000 ml of acetone were added to the thus heated aqueous solution. After stirring the mixture under heating and then leaving the thus heated mixture for 7 hours under the atmosphere, the precipitated substance was removed from the mixture and the supernatant liquid was condensed and dried to be a solid.

After dissolving the solid in 100 ml of water to obtain a liquid (referred hereinafter to as secondary extracted liquid), the secondary extracted liquid was combined with the above-mentioned condensed hydrolyzate (about 200 ml) and 2000 ml of acetone were mixed with the thus combined liquid.

The thus precipitated, insolubilized substance was removed from the mixture by sedimentation whereby obtaining a supernatural liquid containing 24.51 g of rhamnose, 25.42 g of arabinose and 7.01 g of galactose.

After evaporating and drying the supernatant to a solid by heating, the thus obtained solid was dissolved in 30 ml of water, and the thus prepared aqueous solution was subjected to ion-exchanging resin-chromatography to separate rhamnose therefrom, the conditions of chromatography being as follows Strongly cationic ion-exchanging resin: AMBERLITE® (made by Rohm and Haas Co. CG-120 Na type Eluent: a mixture of ethanol and water (80:20 by volume)

Column: 600 mm in length and 25 mm in inner diameter, with vat volume of 300 ml

Flow rate: 10 ml/min

Temperature: 75° C.

Detector: RI

The elution curves of monosaccharides in the chromatography are shown in FIG. 1, which was obtained by using 10 ml of the total 60 ml of the eluate.

After fractionally collecting the rhamnose fraction of the eluate and condensing the thus collected fraction, the condensate was dissolved in 200 ml of water, and the thus prepared aqueous solution was passed through a column which was packed with 10 g of activated carbon (for chromatography, made by Wako Pure Chemical Co., Ltd.) at a speed of 10 ml/min, and the adsorbed material on the column was eluted by 200 ml of water. By condensing the eluate, 22 g of rhamnose were obtained in a yield of about 80% at a purity of higher than 99.5% and it showed a specific rotatory power, $[\alpha]_D^{20°}$, of +8.4 (C=4, $H_2O$), the published value of rhamnose being $[\alpha]_D^{20°}$+8.2 (C=4, $H_2O$).

The once used activated carbon was made reusable by washing with 100 ml of a mixture (6:4 by volume) of water and acetone, or with 100 ml of a mixture (6:4 by volume) of water and ethanol, and then further with 200 ml of water.

EXAMPLE 3

To 250 g of powdery gum arabic, 1000 ml of 0.4N sulfuric acid were added, and after heating the mixture under a reflux condenser for 2.5 hours thereby subjecting to hydrolysis of gum arabic, the hydrolyzate was neutralized by barium hydroxide and condensed by evaporating about 800 ml of water from the neutralized liquid hydrolyzate at an elevated temperature.

The hydrolysis of gum arabic was carried out under the same conditions as above, and the obtained secondary extracted liquid (prepared by using ethanol instead of acetone in Example 2) was added to the thus obtained condensate. After adding 2000 ml of acetone heated to 50° C. to the mixture of the secondary extracted liquid-.and the condensate, heating the thus obtained mixture to 50° C. under stirring and then leaving the mixture for 7 hours under the atmosphere, the thus precipitated solid material was removed from the mixture by centrifugation, and the separated liquid layer was distilled to dry up. The thus obtained solid residue was dissolved in 30 ml of water, and the aqueous solution was subjected to strongly cationic ion-exchanging resin-chromatography under the following conditions.

Strongly cationic ion-exchanging resin: DOWEX® (made by Dow Chemical Co.) 50w-X8 Na type Eluent: a mixture of acetone and water (65:35 by volume)

Column: 600 mm in length and 25 mm in inner diameter with vat volume of 300 ml

Flow rate: 10 ml/min

Temperature: 55° C.

Detector: RI

The thus obtained rhamnose fraction was collected and condensed. The purity of the thus obtained rhamnose was about 98%.

After dissolving the thus obtained rhamnose in 200 ml of water, the thus prepared solution was subjected to treatment by activated carbon as in Example 2. The yield and the purity of the thus purified rhamnose were about 84% and higher than 99.5%, respectively, and the specific rotatory power thereof was $[\alpha]_D^{20°}$+8.3 (C=4, $H_2O$), the published value of the specific rotatory power of rhamnose being $[\alpha]_D^{20°}$+8.2 (C=4, $H_2O$).

Figure 2:
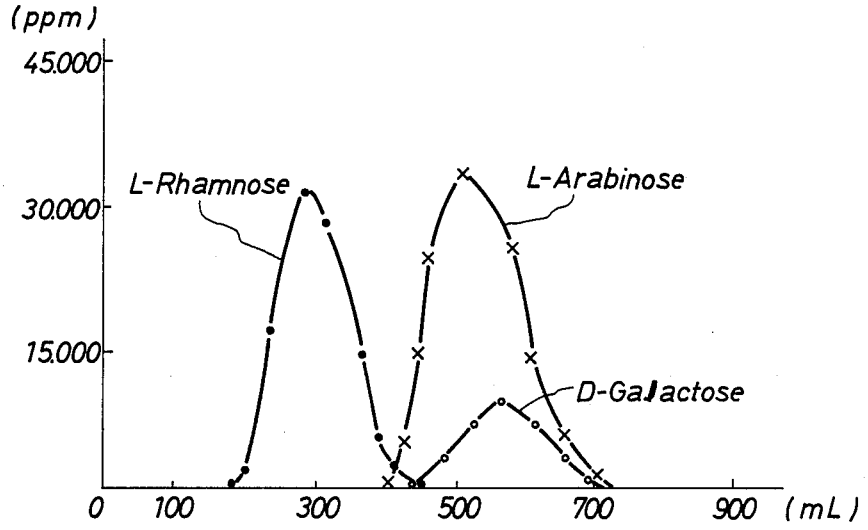

FIG. 2 shows the elution curve of rhamnose in Example 3 which was obtained by 10 ml of the total 60 ml of the eluate. Incidentally, the separated, insolubilized substance obtained in this example where acetone was added to the condensate of the hydrolyzate can be extracted and utilized as the secondary extracted liquid.

EXAMPLE 4

After adding 1000 ml of 0.3N hydrochloric acid to 250 g of powdery gum arabic and heating the mixture under a reflux condenser for 2 hours under agitation thereby subjecting to the hydrolysis of gum arabic, the reaction mixture was neutralized by sodium hydroxide and condensed by evaporating about 800 ml of water therefrom at an elevated temperature. The secondary extracted liquid obtained by carrying out the hydrolysis of gum arabic under the same conditions as above (while using acetonitrile instead of acetone in Example 2) was added to the above-mentioned condensate, and after adding 2000 ml of acetonitrile heated to 70° C. to the thus obtained mixture, the thus obtained mixture was stirred under heating.

After leaving the whole mixture for 7 hours under the atmosphere, the thus precipitated solid material was removed from the mixture, and the remaining liquid phase was evaporated to be a solid material. After dissolving the solid material in 30 ml of water, the thus obtained aqueous solution was subjected to strongly cationic ion-exchanging resin-chromatography to collect the rhamnose fraction under the following chromatographic conditions.

Strongly cationic ion-exchanging resin: AMBERLITE® CG-120H Na type

Eluent: a mixture of acetonitrile and water (75:25 by volume)

Column: 600 mm in length and 25 mm in inner diameter with vat volume of 300 ml

Flow rate: 10 ml/min

Temperature: 20° C.

Detector: RI

The purity of rhamnose of the rhamnose fraction was about 98%. The purity of rhamnose obtained by dissolving the rhamnose fraction in 200 ml of water and treating the aqueous solution by activated carbon was higher than 99.5%, and the yield thereof was about 84%. The specific rotatory power of the thus purified rhamnose was $[\alpha]_D^{20°}+8.3$ (C=4, $H_2O$), the published value of rhamnose being $[\alpha]_D^{20°}+8.2$ (C=4, $H_2O$).

Figure 3:
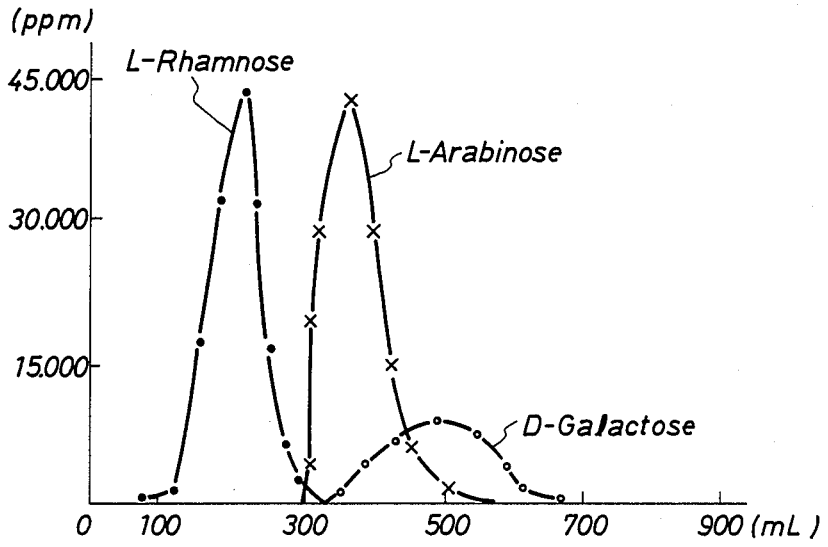

FIG. 3 shows the elution curve of rhamnose fraction in Example 4 wherein about 10 ml of the total amount of 60 ml of the eluate was used.

In addition, the precipitated, insolubilized substance separated in the case where acetonitrile was added to the condensed hydrolyzate can be utilized as the source of secondary extracted liquid.

COMPARATIVE EXAMPLE 1

In the case where the neutralized hydrolyzate of gum arabic obtained as in Example 1 was added with 2000 ml of acetone without having been condensed, and the thus precipitated, insolubilized substance was removed from the thus treated, neutralized hydrolyzate, the monosaccharides in the remaining liquid contained 26.81 g of rhamnose, 55.40 g of arabinose and 24.32 g of galactose.

Although the compositional ratio of the three monosaccharides in the liquid was the same as that in the liquid hydrolyzate, the above-mentioned liquid contained oligosaccharides and high molecular weight-substance in the same time, and it was necessary to remove such oligosaccharides and the high molecular weight-substance therefrom with additional step.

COMPARATIVE EXAMPLE 2

In the case where the concentration of the acid used in the hydrolysis of gum arabic was higher than that in Example 1, the compositional ratios of the three monosaccharides in the liquid hydrolyzate were as follows.

| Acid and its concentration | Rhamnose:Arabinose:Galactose | | |
|---|---|---|---|
| 1N—HCl | 1 | 2.2 | 3.4 |
| 2N—HCl | 1 | 2.3 | 4.0 |
| 3N—$H_2SO_4$ | 1 | 2.3 | 3.5 |

In the case where a large amount of galactose was contained in the liquid hydrolyzate, the compositional ratio of galactose to rhamnose in the succeeding step of addition of the polar organic solvent was higher in some extent than that in the usual case, and furthermore, the content of galactose in the secondary extracted liquid became extremely higher than that in the usual case. As a result, the content of galactose in the solution to be subjected to ion-exchanging resin-chromatography was higher than that in the usual case, and the efficiency of purification of rhamnose was lower than that of the present invention.

What is claimed is:

1. A process for producing highly pure rhamnose from gum arabic, comprising:

partially hydrolyzing gum arabic in an aqueous solution of a mineral acid to the extent that $\frac{1}{3}$ to $\frac{1}{2}$ of the constructing saccharides of the gum arabic converts into monosaccharides comprising L-rhamnose, L-arabinose and D-glactose, to produce a liquid hydrolysate comprising said monosaccharides;

neutralizing the liquid hydrolysate by adjusting the pH of the liquid hydrolysate to 6.5 to 7.5 so as to produce a neutralized hydrolysate, said adjusting being accomplished by adding an aqueous solution of an alkali;

condensing the neutralized hydrolysate by evaporating water contained therein so as to obtain an aqueous solution containing 40 to 70% by weight of said monosaccharides;

adding a polar organic solvent to the resulting aqueous solution in a volume equal to 5 to 20 times the volume of the aqueous solution containing 40 to 70% by weight of said monosaccharides, thereby precipitating an insoluble substance;

removing the insoluble substance from the resulting mixture of the aqueous solution containing 40 to 70% by weight of said monosaccharides and polar organic solvent by centrifugation, filtration or sedimentation;

removing the polar organic solvent from the mixture by evaporation so as to produce a solvent-free aqueous solution;

subjecting said solvent-free aqueous solution to strongly cationic ion-exchanging resin-chromatography to remove mainly D-galactose and L-arabinose, using a mixture of 40 to 20 parts by volume of water and 60 to 80 parts by volume of acetone or acetonitrile as an eluent and performing the elution at a temperature from room temperature to 60° C. to produce a chromatographically purified aqueous solution; and condensing the chlormatographically purified aqueous solution, dissolving the condensed material in water, passing the resulting aqueous solution of the condensed material through a column packed with activated carbon and eluting adsorbed material on the carbon by water, to remove colored substances.

2. The process according to claim 1, wherein the normality of said aqueous solution of said mineral acid is from 0.1 to 0.6.

3. The process according to claim 1, wherein said mineral acid is sulfuric acid or hydrochloric acid.

4. The process according to claim 1, wherein said alkali is calcium hydroxide, barium hydroxide, potassium hydroxide or sodium hydroxide.

5. The process according to claim 1, wherein said polar organic solvent is ethanol or isopropyl alcohol.

6. The process according to claim 1, wherein the removal of said polar organic solvent by evaporation is effected by distillation.

7. The process according to claim 1, wherein said polar organic solvent is acetone or acetonitrile.

* * * * *